US007469966B1

(12) United States Patent
Vallee

(10) Patent No.: US 7,469,966 B1
(45) Date of Patent: Dec. 30, 2008

(54) SEAT WITH TILTING SEATING SURFACE

(75) Inventor: Bernard Vallee, La Queue en Brie (FR)

(73) Assignee: Delagrave S.A., Paris (FR)

( * ) Notice: Subject to any disclaimer, the term of this patent is extended or adjusted under 35 U.S.C. 154(b) by 0 days.

(21) Appl. No.: 09/936,251

(22) PCT Filed: Mar. 10, 2000

(86) PCT No.: PCT/FR00/00588

§ 371 (c)(1),
(2), (4) Date: Sep. 7, 2001

(87) PCT Pub. No.: WO00/54629

PCT Pub. Date: Sep. 21, 2000

(30) Foreign Application Priority Data

Mar. 17, 1999 (FR) ..... 99 03282

(51) Int. Cl.
*A47C 1/00* (2006.01)
*A47C 7/62* (2006.01)
*A47B 39/00* (2006.01)

(52) U.S. Cl. ..... 297/332; 297/331; 297/335; 297/146; 297/163; 297/188.04

(58) Field of Classification Search ..... 297/332, 297/331, 335, 334, 163, 188.04, 146, 164
See application file for complete search history.

(56) References Cited

U.S. PATENT DOCUMENTS

| | | | | | |
|---|---|---|---|---|---|
| 928,929 | A | * | 7/1909 | Betherum | 248/423 |
| 1,231,129 | A | * | 6/1917 | Cluff | 297/332 |
| 3,594,037 | A | * | 7/1971 | Sherman | 297/14 |
| 4,458,942 | A | * | 7/1984 | Crossman | 297/331 |
| 4,787,675 | A | * | 11/1988 | McLeod | 297/335 |
| 5,026,118 | A | * | 6/1991 | Vander Stel et al. | 297/238 |
| 5,094,508 | A | * | 3/1992 | Bathrick et al. | 297/320 |

FOREIGN PATENT DOCUMENTS

EP 0 518 346 A1 * 12/1992

* cited by examiner

*Primary Examiner*—Sarah B McPartlin
(74) *Attorney, Agent, or Firm*—Bachman & LaPointe, P.C.

(57) ABSTRACT

The chair has a seat that folds down about a horizontal axle 24 and which is intended, in particular, to equip halls that receive the public, such as lecture theatres and/or show halls. This chair comprises at least an underframe having an essentially longitudinal axis 14 and to which a backrest 16 may be fixed, and with respect to which a fixed horizontal axle 24 is determined. The seat 20 comprises a first part 32 projecting forwards with respect to the horizontal axle 24, and a second part 30 projecting towards the underframe 12. The underframe 12 contains a gas strut 40, one end 48 of which is fixed to the underframe 12, and the other end 50 of which is fixed to the second part 30 of the seat 20.

6 Claims, 3 Drawing Sheets

SEAT WITH TILTING SEATING SURFACE

FIELD OF THE INVENTION

The present invention relates to chairs which require the seat to be folded up for dimensional and/or legislatory reasons, and which are intended in particular to equip rooms that receive the public (lecture theatres, cinemas, show halls, conference rooms, theatres, multi-purpose halls, etc.).

BACKGROUND OF THE INVENTION

Conventionally, chairs with folding seats comprise at least an underframe which has a roughly longitudinal axis and to which a backrest may be fixed, and with respect to which a horizontal axle is determined, the seat comprising a first part projecting forwards with respect to the horizontal axle and essentially intended to accommodate the seated user, and a second part projecting towards the underframe.

As is known, a folding seat has to fold itself back up when the chair is not in use and must essentially do this and do this in a way which does not deteriorate over time in order to remain compliant with the rules and regulations governing the fitting-out of halls that receive the public and, in particular, to comply with safety standards.

The folding seat must effect an automatic angular rotation of the order of 80 to 110 degrees about the aforementioned horizontal axle when the chair thus equipped is not in use, so as to adopt a roughly vertical position.

To this end, either the second part of the seat is provided with a counterweight, so as to overcome the forces of gravity generated by the first part, or a spring is added, for example a flat spiral spring on the horizontal axle, or a coil spring connecting one of the parts of the seat to the underframe, or alternatively a metal-leaf spring operated by an off-centre shaft, so that the spring is stressed when the seat is deployed and restores the stored energy to close the seat again when the user stands up.

In all cases, a set of elastic stops, for example made of rubber, are provided to slow and halt the angular rotational movement of the seat at the end of its travel. This set of stops necessarily leads to the chair having an increased thickness in the region of the closure mechanism, which results in the seat remaining partially deployed and therefore in the chair occupying additional space when the seat is up.

The raising of the seat through inertia in any case remains lacklustre and carries the risk of not being effected correctly as a result of simple unforeseen friction of the set or friction at the rotational axle.

The various spring-loaded seat-lifting means are, for their part, subject to mechanical fatigue because the spring remains under tension when the seat is deployed when the chair is in the position of use. This then results in relatively short durability of, and significant maintenance on, each chair to regularly change the spring-loading means.

Obviously, such means also result in a substantial acceleration of the angular movement of the seat, which then strikes the end-of-travel stops at full angular speed. The seat therefore, at the end of its travel, bangs against the stops provided for this purpose, and this gives rise to a banging noise which is unacceptable when, for example, in a lecture theatre so equipped, the lecturer has not finished giving his lecture or the show is still going on.

Furthermore, the fact that the seat reaches the elastic stops at high angular speed leads to significant stop wear, and these stops therefore constitute wearing parts which have to be changed regularly to make sure that they exhibit roughly constant characteristics.

Furthermore, the amount by which each seat remains slightly deployed in the up position also depends on the stop wear and therefore on the use of each chair. This results in residual deployment which differs from one chair to another, and soon results in misalignment of the raised seats of one and the same row of chairs. This is unattractive and may lead to problems regarding compliance with safety standards determining the required width of the passageway between the chair with the seat up and the work surface or chair facing it.

Furthermore, as has just been stated, these chairs are subject to a certain number of very tight regulations, because they are used in places that receive the public and, among these tight regulations, the durability factor is very important. The durability factor should be understood as meaning the number of deployment-closure cycles that can be performed before there is an appreciable degradation in the residual amount by which the seat remains deployed. Thus, it is known that a chair equipped with a spring-loaded seat-lifting means is generally not able to withstand more than about 40 000 cycles before the seat-lifting means requires maintenance or changing.

Document U.S. Pat. No. 3,594,037 describes a chair for an air stewardess comprising an operating strut, but in which the seat moves from the vertical to the horizontal position and vice versa about an essentially mobile and non-concrete axis of rotation. The backrest accompanies the seat in its movement and is therefore not fixed. The chair is referenced with respect to the ground, because the problem of tiers at different heights, as in a lecture theatre, does not arise in an aeroplane.

The invention falls within this context and its prime object is to obviate the aforementioned drawbacks while at the same time complying with the regulations in force.

Another object of the invention is to appreciably increase the durability factor, that is to say the number of seat deployment-closure cycles that can be effected without degradation, so as to reduce the need for chair maintenance.

Another object of the invention is to remove the need for a set of stops equipping each chair so as to avoid any additional residual deployment due to the wear of these stops.

SUMMARY OF THE INVENTION

According to the invention, the seat underframe contains a gas strut, one end of which is fixed to the underframe and the other end of which is fixed to part of the seat.

The rotation axle of the chair according to the invention is fixed, and the chair is referenced with respect to the underframe rather than with respect to the ground. Furthermore, the backrest is fixed.

As those skilled in the art will readily understand, the gas strut makes it possible to get around the angular-acceleration and creaking problems inherent to spring-loaded or gravity-operated systems and therefore makes it possible for the seat to return at a roughly constant and controlled speed.

The use of a pneumatic strut to alter the attitude of a surface is, however, well known per se in the art.

Thus, American U.S. Pat. No. 4,534,594 describes an aeroplane armchair, the leg-rest part of which is controlled by a pneumatic strut.

European patent EP-A-0 269 528 describes a bed, some of the elements of which can be adjusted by means of an actuator strut. The actuator is a self-locking device with a compensation mass capable of taking account of the weight of the individual lying on this bed.

Patent WO-A-95/14412 also describes a bed with a raisable head-end and foot-end, comprising a lockable pneumatic strut for immobilizing the bed in the chosen position.

Pressurized gas-strut devices to assist with the lifting of a motor vehicle boot lid or rear hatch are also known.

The problems posed here, namely those of gently (at roughly constant rotational speed) lifting up the seat of a chair to avoid parasitic end-of-travel noises, and of getting around the issue of the premature wear of certain components in order to reduce the chair maintenance requirements have no solution suggested in the aforementioned documents.

The present invention therefore relates to a chair with a seat that folds down about a horizontal axle and which is intended, in particular, to equip halls that receive the public, such as lecture theatres and/or show halls, comprising at least an underframe having an essentially longitudinal axis and to which a backrest may be fixed, and with respect to which a horizontal axle is determined, the seat comprising a first part projecting forwards with respect to the horizontal axle, and a second part projecting from the horizontal axle towards the underframe.

According to the invention, the underframe contains a gas strut, one end of which is fixed to the underframe, and the other end of which is fixed to the second part of the seat.

As a preference, the distance between the horizontal axle and the longitudinal axis of the underframe is between about 2 and 15 cm.

The horizontal axle is carried by an intermediate part projecting from the longitudinal axis of the underframe to which it is fixed.

Advantageously, an opening is made in the underframe, facing the second part of the seat, so as to at least partially accommodate this second part.

According to another embodiment, the horizontal axle of rotation of the seat is carried by an arm which is mounted so that it is free to rotate about a first of its ends which is fixed to the underframe.

BRIEF DESCRIPTION OF THE DRAWINGS

The invention will be better understood and other objects, advantages and features thereof will appear more clearly from reading the description which follows of some preferred embodiments which are given by way of non-limiting example and to which are attached three plates of drawings in which.

DESCRIPTION OF THE PREFERRED EMBODIMENTS OF THE INVENTION

Figure 1:
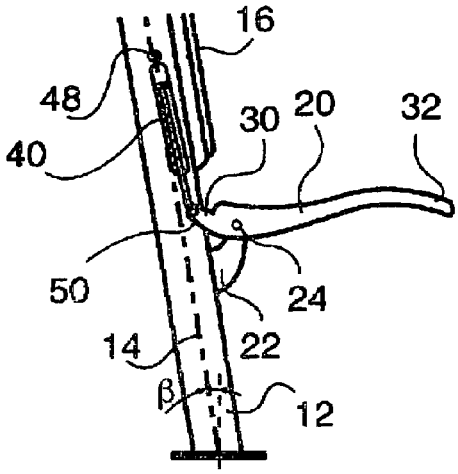
FIGS. 1 and 2 depict, diagrammatically in section on the longitudinal axis of the underframe, a chair for a lecture theatre according to the invention, with the seat deployed and with the seat up, respectively.
Figure 2:
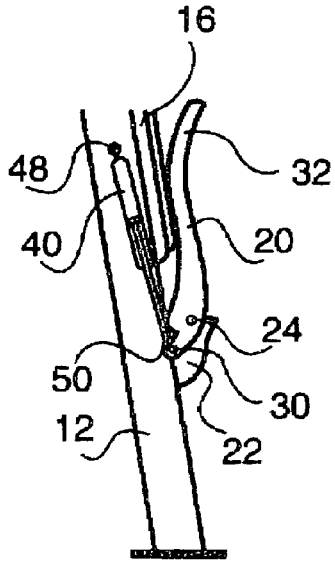

Referring now to the figures which have just been briefly described, and more particularly to FIGS. 1 and 2, there has been depicted, in cross section, a chair with a folding seat of the type comprising a single underframe 12, for example of cylindrical shape, having a longitudinal axis 14 which makes a given angle β with the vertical. This chair illustrates a first embodiment which is given by way of illustration. Quite obviously, a number of other similar embodiments may be realized, with greater or lesser amounts of padding on the seat and on the backrest, depending on the type of use to which the chair is put. Likewise, armrests (not depicted) may be provided.

The angle β that the underframe makes with the vertical, ranging between about 0 and 15 degrees, and preferably equal to about 10 degrees, encourages user comfort because the underframe 12 carries a backrest 16 which is also inclined and set back with respect to the seat 20, with a very ergonomic position. Furthermore, this inclination also encourages safety because it makes it possible to obtain a chair which, when the seat 20 is up, has no parts projecting beyond the underframe, this correspondingly increasing the space freed up for walking past the chair. By way of example, the footprint may thus be reduced to approximately a mere 13 cm.

In the example depicted in FIG. 2, the position in which the front part of the seat 20 is up, is the position in which the chair is not in use.

The seat 20 is fixed to the underframe 12 by means of an intermediate piece 22 determining a horizontal axle 24 about which the seat 20 can pivot. The distance between this horizontal axle 24 and the longitudinal axis 14 of the underframe 12 is between about 2 and 15 cm, depending on the chosen value of the angle β.

The piece 22 also makes it possible to fix the angle through which the seat 20 is deployed and to take up the forces generated by the weight of the user.

The seat 20 consists of two parts joined together. A first part 32 having, for example, a double curvature and/or padding, projects forwards from the horizontal axis 24 and in this instance is intended to accommodate the seated user when the seat 20 is deployed. The second part 30 projects from the horizontal axle 24 towards the underframe 12 and is connected to the seat-lifting mechanism 40.

Figure 5:
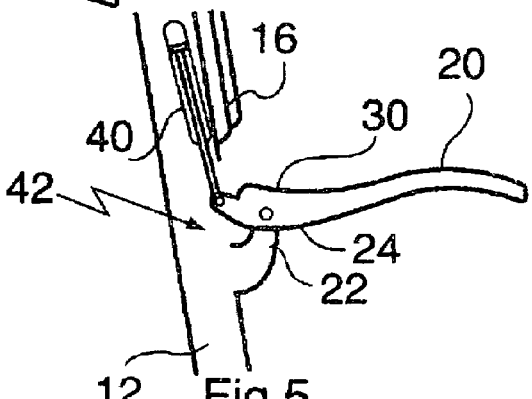
FIG. 5 illustrates in greater detail the connection between the seat and the underframe.

As can best be seen in FIG. 5, the second part 30 of the seat 20 projects into the underframe 12, passing through an opening 42 made therein. The length of that part of the second part 30 which enters the opening is, of course, shorter than the diameter of the underframe 12.

As those skilled in the art will readily understand, it is entirely needless for the upper and lower edges of this opening 42 to be equipped with stops, rubberized or otherwise, because the limit stop on the deployment of the seat 20 consists simply of the end of the intermediate piece 22, as stated earlier, while the limit stop for the end of the closure travel consists of the seat-lifting mechanism itself.

The seat-lifting mechanism 40 consists of a conventional gas strut, one end 48 of which is fixed to the underframe 12, and the other end 50 of which is fixed to the end of the second part 30 of the seat 20, on which it acts to lift the seat up in the manner of a lever.

A gas strut such as this is well known and there is no need to describe its operation in greater detail here. The essential advantage in using such a strut is that it provides an angular rotational movement of the seat 20 which exhibits no inappropriate acceleration upon lifting up. On the contrary even, because the expansion of the gas it contains slows towards the end of the travel, this allows the seat 20 not to bang forcibly against the end-of-travel stops which, in any case, are not used here, this making it possible for the seat 20 to be lifted up quietly and efficiently, or against the chair backrest.

Furthermore, such a gas strut may comprise a device for compensating for wear or for play, and an additional slowing means, both these being known per se.

Figure 3:
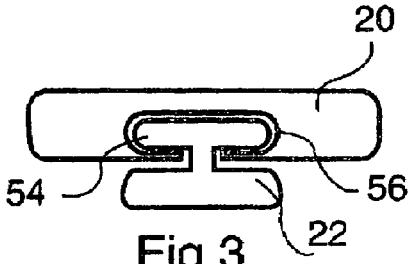
FIG. 3 diagrammatically illustrates one method of fixing the seat to the underframe.

FIG. 3 depicts an alternative form of embodiment. Here, while the horizontal axle 24 is fixed with respect to the underframe 12, the seat 20 is able to move with respect to this horizontal axle 24. As can be seen in FIG. 3 which, in facial section, shows the join between the intermediate piece 22 and the seat 20, the intermediate piece 22 consists of a rail 54 collaborating with a track 56 made in the lower part of the seat 20 so as to alter the position of the horizontal axle 24 with respect to the seat 20 according to the angle to which the seat is deployed. Thus, the seat 20 can additionally slide with respect to the axle 24, making it possible to reduce the footprint of the chair still further when the seat 20 is up. The rail 54 could possibly be mounted so that it can rotate with respect to the intermediate piece 22, should that prove necessary.

Figure 4:
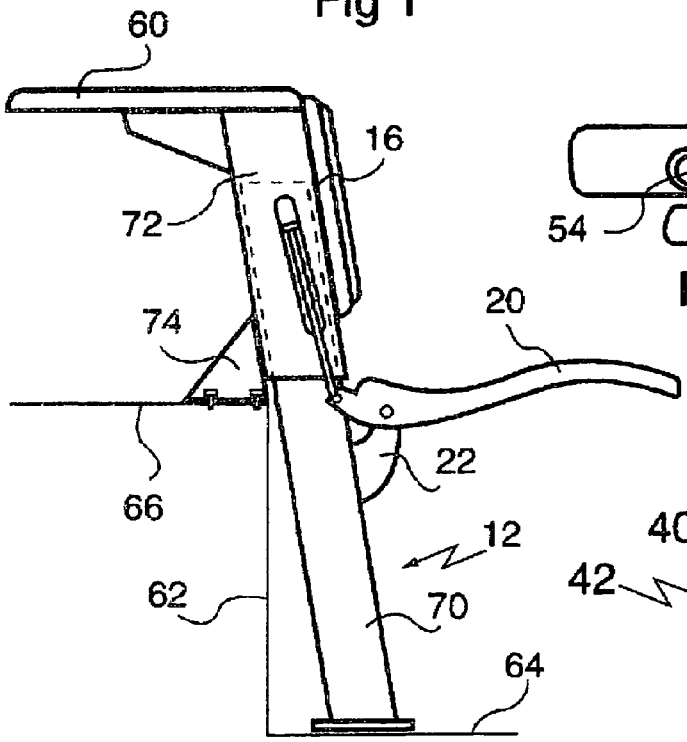
FIG. 4 depicts, diagrammatically in longitudinal section, a chair in accordance with the invention.

Referring now to FIG. 4, the chair according to the invention is intended, in particular, to equip lecture theatres. It is known that in lecture theatres, each row of adjacent chairs occupies a given level 64 separated from the previous and subsequent levels 66 by a fairly large and often variable step height 62. This generally results in a problem because the underframe of a chair is used to carry the work surface 60 for the chair located immediately behind it, and it is therefore necessary to adjust the height of the work surface 60 to suit the step height 62. This problem is solved with the seat of the invention in that the underframe 12 is assembled telescopically with a first element 70 which carries the seat 20 and the seat-lifting mechanism 40 while taking up vertical forces, while a second element 72 carries the next work surface 60. Furthermore, this second element 72 takes up the horizontal forces generated by the weight of the user because of the way 74 in which it is intended to be fixed to the level 66 above in the manner of a buttress.

There has thus indeed been determined a chair with a lift-up seat intended to equip halls that receive the public, such as lecture theatres and show halls, which has the desired advantages, namely quiet operation, and simple adaptation to suit any type of room, which complies with the safety standards in force, and which has no rapidly wearing parts. Furthermore, this type of chair makes it possible to significantly increase the surface area of the work surface associated with it because of the small footprint of the chair with the seat up.

The work surface 60 may also therefore, particularly because of the way it is fixed to the underframe, be designed to considerably limit the customary sounding board effect.

It is noted that, although FIGS. 1 to 5 depict the seat-lifting mechanism 40 in the upper part of the underframe 12, it could just as easily be placed in the lower part of the same underframe 12, operating in a similar but reverse way.

The seat of the chair according to the invention is thus lifted at constant and controlled speed, is slowed at the end of its travel without the use of stops, without appreciable mechanical ageing, with automatic compensation for play, without creaking or grating due to the presence of a spring, without the seat bouncing or banging against the backrest, without free rotation as is found with a counterweight lifting means, and with a durability factor and an endurance over time which are more than twice those of spring-assisted lift-up chairs and, in particular, in accordance with European standard EN 12727 (level 4).

Laboratory tests have actually demonstrated that the number of deployment-closure cycles without appreciable degradation in the residual amount of deployment has been extended to more than 100 000, with a corresponding reduction in chair maintenance requirements.

Figure 6:
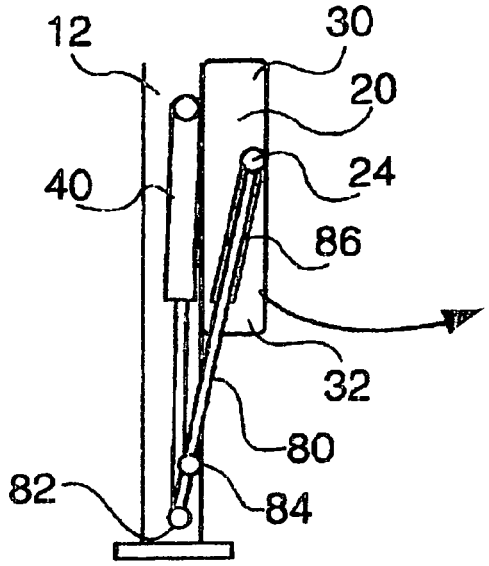
FIGS. 6 and 7 illustrate another embodiment of a chair according to the invention, particularly to equip a show hall, in which the rear part of the seat is moved downwards to determine the deployed or use position of the chair.
Figure 7:
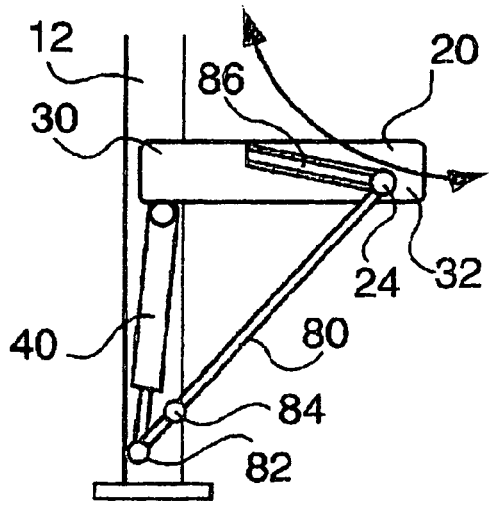

FIGS. 6 and 7 depict, in closed and deployed positions respectively, a chair according to a second embodiment of the invention in which the position in which the rear part 30 of the seat 20 is lowered corresponds to a position of use of the seat.

In this embodiment, the axle 24 of rotation of the seat 20 is carried by an arm 80, one end 84 of which is fixed to the underframe 12 and about which it is mounted to rotate freely. The rear or second part 30 in this instance is lifted up (instead of pushed down as it was in the embodiment of FIGS. 1 to 5) which means that it is the first part 32 of the seat 20 which will move down when the seat is "lifted up".

The mechanism, which still consists of a gas strut 40, therefore operates in the opposite way to that of the mechanism of FIGS. 1 to 5, and there is no need for it to be described in greater detail here. It is fixed to the underframe 12 by its first end 82 which may advantageously but not necessarily be distinct from the axle 84.

As a preference, the other end of the arm 80 which is the opposite end of its first end 84 and which determines the rotation axle 24 is mounted so as to slide in a rail 86 which may be inclined, secured to the seat 20, so as to prevent the seat 20 from closing up again if the user sits on its end.

In the example depicted in FIGS. 6 and 7, the arm 80 is mounted in the form of a lever which has a fulcrum at its axle 84, the axle 82 connected to the strut 40 thus being made mobile. A solution such as this is not, of course, compulsory.

To sit down, the user has to push down on the rear part 30 of the seat or pull on the front part 32 of this seat 20, and the fairly forward position of the axle 24 allows the seat to remain deployed when the user is seated normally.

It is also possible to envisage for the end 82 of the arm 80 to be mounted on an eccentric (not depicted), to encourage the movement of the arm 80.

It is thus indeed possible to obtain a chair with a lift-up seat with excellent ergonomics and in which all the essential parameters can easily be controlled, particularly as regards deployment and closure of the seat with a view to reducing the space occupied by, and weight of, the latter.

Obviously, the backrest and seat may be padded as desired.

Although that which has been depicted and described is that which is currently considered as being the preferred embodiments of the present invention, it is obvious that those skilled in the art may make various changes and modifications thereto without departing from the scope of the present invention as defined hereinafter.

In particular, although the underframe has been described as having a roughly cylindrical shape in cross section, it is obvious that it could just as easily adopt a square or triangular shape in cross section, or even adopt the shape of a T or of a U in cross section, the seat-lifting mechanism then being directly accessible without the need to completely disassemble the underframe, for example to change it.

It is, however, desirable for its seat-lifting mechanism to be and remain inaccessible to the user of the chair and to his neighbours in order to avoid any accident of the trapping type, and any unforeseen degradation.

Figure 8:
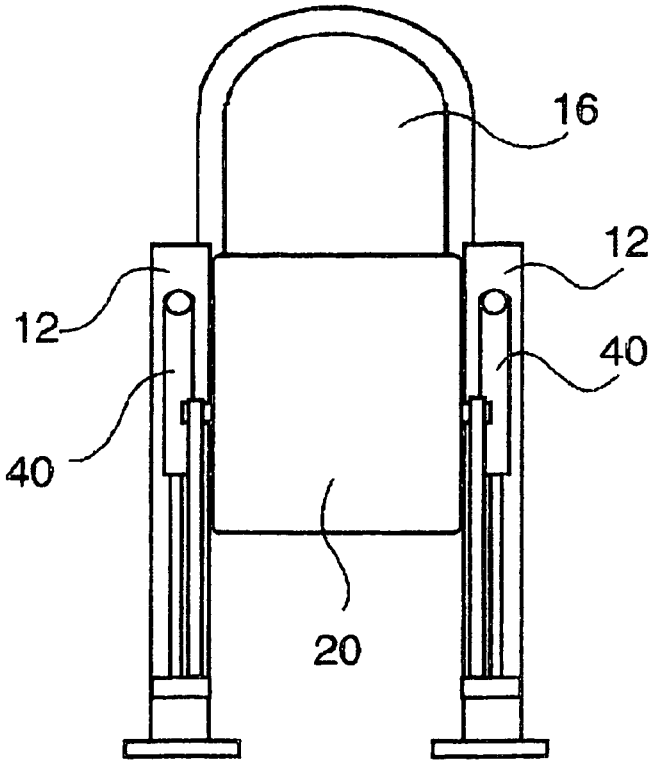
FIG. 8 depicts diagrammatically, in a view from behind, a chair according to the invention, particularly to equip a theatre, employing two underframes, each being equipped with a seat-lifting mechanism.

Likewise, the underframe has been described as being a single underframe centred on the axis of symmetry of the seat, but it is obvious that the underframe could be offset from this axis of symmetry, for example for aesthetic purposes, or could consist of two parallel elements, one or both of which would accommodate a seat-lifting mechanism as has been depicted diagrammatically in FIG. 8.

Likewise also, the invention can easily be adapted so that the seat-lifting mechanism is located inside the backrest itself, so as to dissociate the actual chair from its underframe with a view to dissociating the problems associated with the underframe from those associated with the seat.

Figure 9:
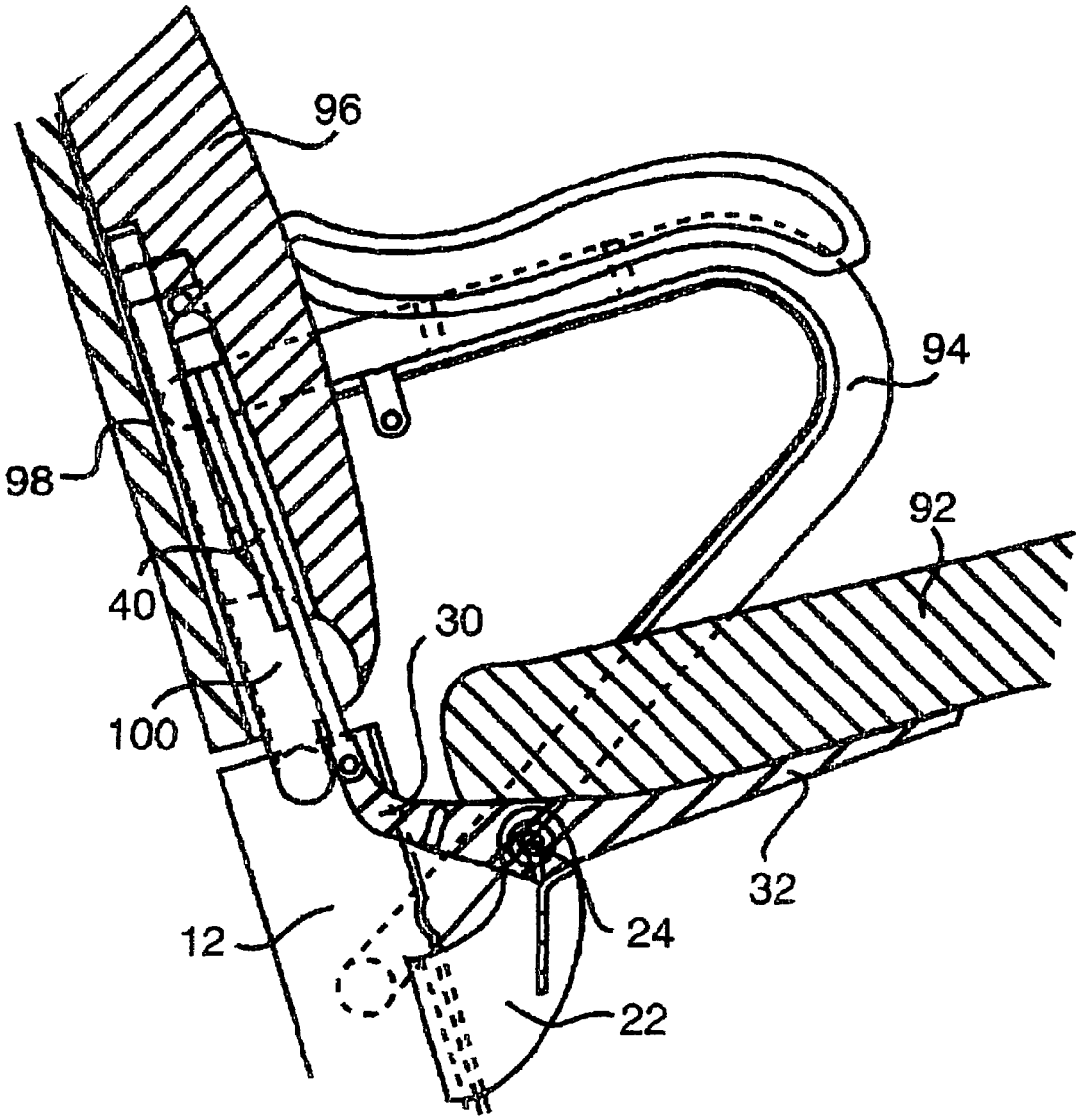
FIG. 9 illustrates the use of the invention to produce an armchair for a theatre or equivalent.

Thus, FIG. 9 diagrammatically depicts an armchair intended, in particular, to equip a theatre or the like. In this example, the seat comprises a padded part 92; the same is true of the backrest which consists of a hard panel 98, for example made of wood, and padding 96. The backrest is fixed to the underframe 12 by means of a fork 100 and armrests 94 are provided on each side of the chair.

The seat-lifting mechanism 40 is, in this instance, housed between the hard panel 98 and the padding 96 of the backrest. This thus yields a highly attractive armchair which exhibits all the aforementioned advantages.

What I claim is:

1. A chair having a folding seat that rotates about a fixed horizontal pivot axis between a substantially vertical rest position and a substantially horizontal use position, the chair being intended, in particular, to equip halls that receive the public, such as lecture theatres and/or show halls, the chair comprising at least an underframe having an essentially longitudinal axis and to which a backrest may be fixed, the underframe comprising at least a first stationary element for taking up vertical forces, the fixed horizontal pivot axis being fixed relative to the first stationary element and to the seat, said seat comprising a first part projecting forwards with respect to said fixed horizontal pivot axis, and a second part projecting towards said underframe, wherein said underframe contains a gas strut having a first end pivotably fixed to said second part of said seat and a second end pivotably fixed relative to the underframe, and the gas strut biases the folding seat toward the substantially vertical rest position.

2. The chair according to claim 1, wherein said horizontal pivot axis and said longitudinal axis of said underframe are spaced apart by a distance between about 2 and 15 cm.

3. The chair according to claim 1, wherein a rail collaborates with said seat to position said horizontal pivot axis with respect to said seat according to an angle β by which said seat is deployed.

4. The chair according to claim 1, wherein an opening is made in said underframe, facing said second part of said seat, so as to partially accommodate said second part.

5. The chair according to claim 1, wherein said longitudinal axis makes a determined angle Beta with a vertical plane, said underframe being assembled telescopically, a first element of said underframe carrying said seat and said strut, and taking up vertical forces, while a second element of said underframe takes up those forces which are orthogonal to said vertical plane which are encountered when the chair is in use.

6. The chair according to claim 5, wherein said second element is capable of carrying a work surface for a user seated behind said chair.

* * * * *